US011772118B2

(12) United States Patent
Muck

(10) Patent No.: US 11,772,118 B2
(45) Date of Patent: Oct. 3, 2023

(54) WATER FEATURE FOR GENERATING AN ILLUMINATED WATER IMAGE

(71) Applicant: OASE GmbH, Hörstel-Riesenbeck (DE)

(72) Inventor: Thorsten Muck, Ibbenbüren (DE)

(73) Assignee: OASE GmbH, Hörstel-Riesenbeck (DE)

( * ) Notice: Subject to any disclaimer, the term of this patent is extended or adjusted under 35 U.S.C. 154(b) by 73 days.

(21) Appl. No.: 17/147,722

(22) Filed: Jan. 13, 2021

(65) Prior Publication Data

US 2021/0220862 A1 Jul. 22, 2021

(30) Foreign Application Priority Data

Jan. 20, 2020 (DE) ..... 10 2020 101 238.1

(51) Int. Cl.

| | |
|---|---|
| ***B05B 17/08*** | (2006.01) |
| ***B05B 15/652*** | (2018.01) |
| ***F21V 33/00*** | (2006.01) |
| *F21W 121/02* | (2006.01) |

(52) U.S. Cl.

CPC ..... *B05B 17/08* (2013.01); *B05B 15/652* (2018.02); *F21V 33/00* (2013.01); *F21W 2121/02* (2013.01)

(58) Field of Classification Search

CPC ..... B05B 17/08; B05B 15/652; F21V 33/00; F21W 2121/02

USPC ..... 239/18, 587.4, 600

See application file for complete search history.

(56) References Cited

U.S. PATENT DOCUMENTS 5,862,984 A * 1/1999 Chang ..... B05B 17/08 239/18

8,403,237 B2 3/2013 Ficyk et al.

* cited by examiner

*Primary Examiner* — Christopher S Kim

(74) *Attorney, Agent, or Firm* — Gudrun E. Huckett

(57) ABSTRACT

A water feature for generating an illuminated water image has a housing and an illumination unit fixedly arranged in the housing. A water channel passes through the housing. A nozzle insert is disposed in the water channel and is designed to create a water image. The nozzle insert is supported so as to be pivotable relative to the illumination unit. The nozzle insert is supported so as to be pivotable about a pivot point, wherein the pivot point is positioned at a same level with or below a light-emitting top side of the housing. An alignment and fixation tool is provided that has first contact elements designed to engage second contact elements of a securing element that secures the nozzle insert so that the securing element can be released or fixed by rotation of the tool.

23 Claims, 5 Drawing Sheets

WATER FEATURE FOR GENERATING AN ILLUMINATED WATER IMAGE

BACKGROUND OF THE INVENTION

The invention relates to a water feature for generating an illuminated water image. The water feature comprises an illumination unit which is fixedly arranged in a housing and further comprises a water channel that passes through the housing, in particular centrally. The water channel is provided with a nozzle insert for producing a water image.

Such water features are employed in private spaces as well as in public spaces for staging gardens or squares. Depending on the employed water nozzle, a plurality of water images can be generated in which, for example, the height, the opening angle and/or the exit vector of the water exiting from the water feature varies. Depending on the selection of the water image, the exiting water is illuminated in different ways by the light of the illumination unit and a different overall appearance is produced in this way.

Particularly when installing such a water feature in a horizontally extending receptacle structure, for example, a flooring, the housing often cannot be aligned exactly horizontally. In case of a water feature that is installed at a slant, the water exits in the wrong direction which spoils the desired water image. For example, the water jet does not exit perpendicularly relative to the ground as desired, but at a slant. In order to correct this, usually the entire water feature must be removed and newly aligned; this means a considerable expenditure.

The object of the invention is therefore to provide a water feature that avoids the aforementioned disadvantages.

The object of the invention is furthermore to provide a water feature that is suitable for installation in a flooring that is to be walked on.

It is furthermore an object of the invention to provide a water feature in which a high variability of the water image by use of various nozzle inserts is possible and in which the nozzle inserts cannot be removed too easily.

SUMMARY OF THE INVENTION

In accordance with the invention, the object is achieved by a water feature for generating an illuminated water image, in particular for horizontal installation, that comprises an illumination unit fixedly arranged in a housing and a water channel passing through the housing, in particular centrally, wherein the water channel is provided with a nozzle insert for producing a water image, wherein the nozzle insert is supported to be pivotable relative to the illumination unit, wherein the nozzle insert is supported to be pivotable about a pivot point that is positioned at the same level as or below a light-emitting top side of the housing.

The water feature according to the invention comprises a nozzle insert that is supported so as to be pivotable relative to the illumination unit which is fixedly arranged in the housing of the water feature. The nozzle insert is supported in this context so as to be pivotable about a pivot point which is positioned at the same level as or below a light-emitting top side of the housing, i.e., the side where the light emitted by the illumination unit exits from the housing. By pivoting the nozzle insert, the direction of the exiting water can be adjusted and an installation position of the housing deviating from an exactly horizontal position can be compensated in this way. By means of the pivot point that is located as close as possible to the housing, the nozzle insert can be arranged so as to project as little as possible away from the housing.

Such a water feature comprises a particularly minimal installation size so that it is in particular suitable for installation in a flooring that is to be walked on because it does not present a tripping hazard. Preferably, the housing provides a nozzle receptacle in this context such that at least a major portion of the nozzle insert, in particular the complete nozzle insert, can be inserted into the housing from the top side of the housing. The major portion of the nozzle insert is inserted in the housing when the predominant portion of the nozzle insert is arranged below the top side of the housing.

In particular, the pivot point of the nozzle insert is positioned below the top side of the housing at a distance in a range from 0 mm to 30 mm, preferably between 5 mm to 25 mm, particularly preferred between 5 mm to 10 mm. In this context, the distance of the pivot point in relation to the top side of the housing is measured in the direction of a water channel center axis of the water channel that extends in vertical direction in a precisely horizontal installation position of the housing. In particular, the top side is defined as the side of the housing which is the visible side of the housing in the installation position of the housing. Light-transmissive parts, for example, a (plexiglass or acrylic glass) glazing are understood in this context as part of the housing.

The housing is preferably embodied as an installation housing that in the installed position is mostly recessed in a receiving structure, for example, a flooring.

In one embodiment of the invention, the water feature comprises a securing element that at least partially engages around the nozzle insert, that secures the nozzle insert at the housing, and that, in the installed state, is substantially flush with the top side of the housing. In this manner, a particularly compact configuration is achieved in which the nozzle insert is fastened securely at the housing. In particular, the securing element in this context is embodied as a securing ring provided with an outer thread screwable into the housing or embodied as a spring ring that can be inserted into the housing. The securing element in this context ends substantially flush with the top side of the housing when it projects, in the direction of the water channel center axis, by at most by 5 mm, preferably by at most 3 mm, past the top side.

According to a further preferred embodiment of the invention, the nozzle insert has in particular a planar top side which in at least one pivot position of the nozzle insert ends substantially flush with the top side of the housing. In particular, this is a pivot position in which the nozzle insert projects by the least amount past the top side of the housing, for example, in case of the nozzle center axis of the nozzle extending parallel and/or coaxially relative to the water channel center axis. The top side of the nozzle insert is substantially flush with the top side of the housing in this context when, in the direction of the water channel center axis, it projects relative to the top side by at most 5 mm, preferably at most 3 mm. Due to this constructive measure on the part of the nozzle head, the water feature can be designed even more compact, in particular more flat.

Preferably, a top side of the nozzle insert that is of a planar configuration adjoins a virtual plane extending perpendicularly to the nozzle center axis. Due to this geometric relationship, the nozzle insert can be aligned comfortably by positioning and aligning its top side precisely horizontally.

In a further preferred embodiment of the invention, the nozzle insert together with the housing forms a joint with an at least partially spherical segment-shaped guide contour. Due to this nozzle insert/nozzle receptacle pair configured in the manner of a ball joint, a housing which is not precisely horizontally arranged can be compensated optimally in all directions. In this context, the spherical segment-shaped guide contour can be formed by a part of the housing, in particular by a part of a flange insert of the housing, and can interact with a contour of the nozzle insert. Preferably, the spherical segment-shaped guide contour is formed by an exterior contour of the nozzle insert and forms, together with at least one additional contour of the housing, a connection of the ball joint kind. In particular, the securing element comprises in this case a centering inner surface that is facing the nozzle insert and is correspondingly embodied complementary to the spherical segment-shaped outer contour of the nozzle insert. The spherical segment-shaped outer contour of the nozzle insert can thus glide on the centering inner surface so that the securing element securing the nozzle insert furthermore contributes to optimal guiding of the nozzle insert. In addition, the nozzle insert inserted into the housing is aligned into its proper installation position upon insertion of the securing element.

In a further advantageous embodiment of the invention, the nozzle insert is configured to be pivotable relative to a pivot position that is coaxial to the water channel by at most ±45 degrees, preferably by at most ±30 degrees, particularly preferred by at most ±15 degrees. By means of such a limited pivoting range, housing and nozzle receptacle can be designed to have a particularly compact configuration. A pivot position of the nozzle insert which is coaxial to the water channel is to be understood as a pivot position in which the nozzle center axis extends parallel to the water channel center axis.

According to a further preferred embodiment of the invention, the housing comprises a flange insert which is insertable from a bottom side of the housing into the housing and detachably secured, wherein the flange insert comprises a bearing contour on which the nozzle insert is supported. This flange insert which in particular can be screwed into the housing from the bottom side serves as a support for the nozzle insert which is inserted from above into the housing. In addition, the flange insert provides a connection for a water line. The bearing contour of the flange insert is designed in this context to be conically tapering. In this way, the nozzle insert can be optimally aligned upon insertion into the housing or placement onto the bearing contour. Moreover, it is also possible to securely arrange different nozzle inserts comprising a spherical segment-shaped outer contour of different spherical segment radii in the housing.

In a further advantageous embodiment of the invention, the nozzle insert comprises at least one guide projection which projects into a guide receptacle of the housing for limiting its pivot movement. The guide receptacle is preferably formed by a length section of the water channel which is delimited from below by the flange insert and from above by the securing element. In this way, a solution of compact configuration for limiting the pivot movement of the nozzle insert is provided by use of the already existing components of the water feature. Preferably, the guide projection is arranged on a circumferential region of the spherical segment-shaped outer contour of the nozzle insert and extends preferably all the way around the circumference.

The aforementioned object is furthermore solved by a set comprising a water feature of the invention and an alignment and fixation tool, wherein the alignment and fixation tool comprises at least one tool-associated contact element that is designed complementary to at least one water feature-associated contact element of the securing element such that the tool-associated contact element can be brought into a form fit engagement with the water feature-associated contact element so that the securing element can be fixed or released by rotation of the alignment and fixation tool, in particular about a tool axis of rotation which extends parallel to or coincides with a water channel center axis in a form fit position.

In such a set, the alignment and fixation tool comprises at least one tool-associated contact element that is designed complementary to at least one water feature-associated contact element of the securing element such that the tool-associated contact element can be brought into form fit engagement with the water feature-associated contact element. By rotation of the alignment and fixation tool, in particular about a tool axis of rotation which is extending parallel to a water channel center axis during form fit engagement, the securing element can be fixed or released. By combining the water feature with a tool which is especially adapted to the water feature, the nozzle insert can be fastened securely at the housing and cannot be removed by conventional means so that the water feature is suitable particularly well for installation in public spaces.

In an embodiment of the invention, the tool-associated contact element and the water feature-associated contact element are configured such that they form a connection with a projection that engages a recess. In particular, the recess and the projection extend parallel to the water channel center axis. In this context, the tool-associated contact elements can be configured as projections and the water feature-associated contact elements as recess. Alternatively, the water feature-associated contact elements can be configured as projections and the tool-associated contact elements as recess. Moreover, some of the tool-associated contact elements can be configured as recesses and some others as projections while the interacting water feature-associated contact elements are embodied in complementary shape thereto, respectively.

According to a further preferred embodiment of the invention, the alignment and fixation tool comprises at least two, preferably at least three, particularly preferred four, contact elements which are arranged in the circumferential direction about its tool axis of rotation. In this way, the alignment and fixation tool can engage optimally the securing element and fasten or release it by rotation.

In a further preferred embodiment of the invention, the alignment and fixation tool comprises at least one grip element which is extending transversely to the tool axis of rotation. In this way, a larger lever for the alignment and fixation tool is provided so that the securing element can be fixed and released better. Preferably, the alignment and fixation tool comprises two oppositely positioned grip elements. In this way, the securing element can be fixed or released in an optimal way with one hand. Preferably, at least one of the grip elements comprises at least one engagement region for engagement of a lever enlarging element. In this way, the lever can be further enlarged so that in particular stuck securing elements can be released better. The engagement region is in particular in the form of a preferably continuous cutout in the grip element.

In a further preferred embodiment of the invention, the alignment and fixation tool comprises a circular level. With it, the alignment of the nozzle insert in an exactly horizontally aligned position is possible. Preferably, for this purpose, the circular level can be removed from the alignment and fixation tool. In this way, the circular level can be positioned directly on the nozzle insert, in particular on a planar surface of the nozzle insert, for checking the alignment.

As a whole, with the present invention a novel water feature is provided that without great expenditure enables compensation of an installation position of the housing that is not precisely horizontal so that an optimal water image can be obtained. By skillful constructive measures, the water feature has a minimal installation size and is suitable therefore particularly for installation in receiving structure that can be walked on. Finally, the water feature according to the invention provides the possibility of employing different nozzle inserts and, in this way, obtain different water images without the nozzle inserts being removable too easily.

It is expressly noted that the afore disclosed configurations of the invention can be combined each individually, but also in any technically expedient combination among each other, with the subject matter according to at least one of the independent claims. Further modifications and configurations of the invention can be taken from the following subject matter description and the drawings.

BRIEF DESCRIPTION OF THE DRAWING

Further advantages and details can be taken from the embodiments described in the following with the aid of the attached schematic drawings.

DESCRIPTION OF THE PREFERRED EMBODIMENTS

Figure 1:
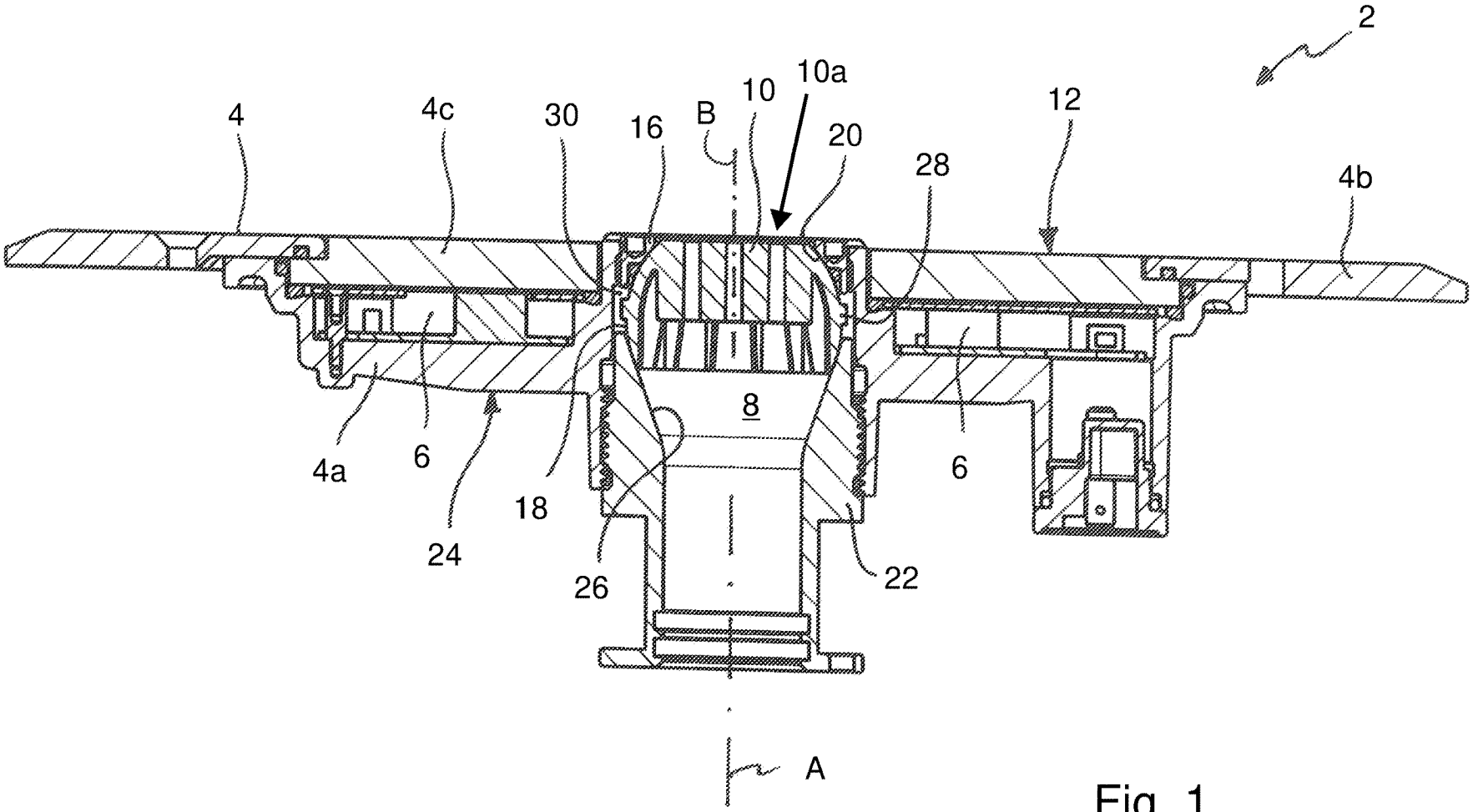
FIG. 1 shows a water feature according to the invention in a cross section view.

Parts that act in the same or a similar way are provided with identical reference characters, if expedient.

Individual technical features of the embodiments described in the following can also be combined in combination with the afore described embodiments as well as the features of the independent claims and dependent claims to subject matter in accordance with the invention.

FIG. 1 shows a water feature 2 according to the invention in a cross section view. The water feature 2 comprises an illumination unit that is fixedly arranged in the housing 4 and is comprised of a plurality of LED (LED=light-emitting diode) groups 6; the water feature 2 further comprises a water channel 8 which is centrally passing through the housing 4. The water channel 8 is provided with a nozzle insert 10 for producing a water image. The housing 4 comprises a core housing 4*a*, a housing cover 4*b*, as well as glazing 4*c*. The light-emitting side of the housing 4 where the light exits represents its top side 12. The nozzle insert 10 is supported so as to be pivotable relative to the illumination unit, fixedly arranged in the housing 4, about a pivot point that is positioned below the top side 12 of the housing 4.

The housing 4 is preferably embodied as an installation housing that in the installed position is mostly recessed in a receiving structure, for example, a flooring.

The housing 4 forms a nozzle receptacle in such a way that the nozzle insert 10 is accommodated completely in the housing 4 in the installation position illustrated here. For this purpose, the nozzle insert 10 is inserted from the top side 12 into the water channel 8 and is secured at the housing 4 by a securing element 16 that engages at least partially around the nozzle insert 10. Here, the securing element 16 is in the form of a securing ring which can be screwed into the housing 4. The securing element 16 in the installed state is substantially flush with the top side 12, i.e., it projects only minimally past the top side 12. The nozzle insert 10 comprises a planar top side 10*a*. In the here illustrated coaxial pivot position in which a nozzle center axis B of the nozzle insert 10 is coaxial with the water channel center axis A of the water channel 8, it is arranged to be flush with the top side 12. In this pivot position, the nozzle insert 10 is also projecting by the least amount past the top side 12.

FIG. 1 also shows that the nozzle insert 10 forms together with the housing 4 a joint with a spherical segment-shaped guide contour 18. The spherical segment-shaped guide contour 18 is formed by an outer contour of the nozzle insert 10 and is positioned at a centering inner surface 20 of the securing element 16. The centering inner surface 20 is embodied in a complementary shape to correspond to the spherical segment-shaped guide contour 18. The housing 4 comprises also a flange insert 22 which can be screwed from the bottom side 24 into the housing 4. The flange insert 22 comprises a conical bearing contour 26 on which the nozzle insert 10 is supported.

On a circumferential region of its spherical segment-shaped outer contour, the nozzle insert 10 comprises a guide projection 28 which is extending completely about the circumference and engages the guide receptacle 30 of the housing 4 for limiting the pivot movement of the nozzle insert 10. The guide receptacle 30 is formed by the water channel 8 itself and is delimited from below by the flange insert 22 and from above by the securing element 16.

The available movement range of the pivot movement of the nozzle insert 10 is limited by the clearance that the guide projection 28 has in the guide receptacle 30.

Figure 2:
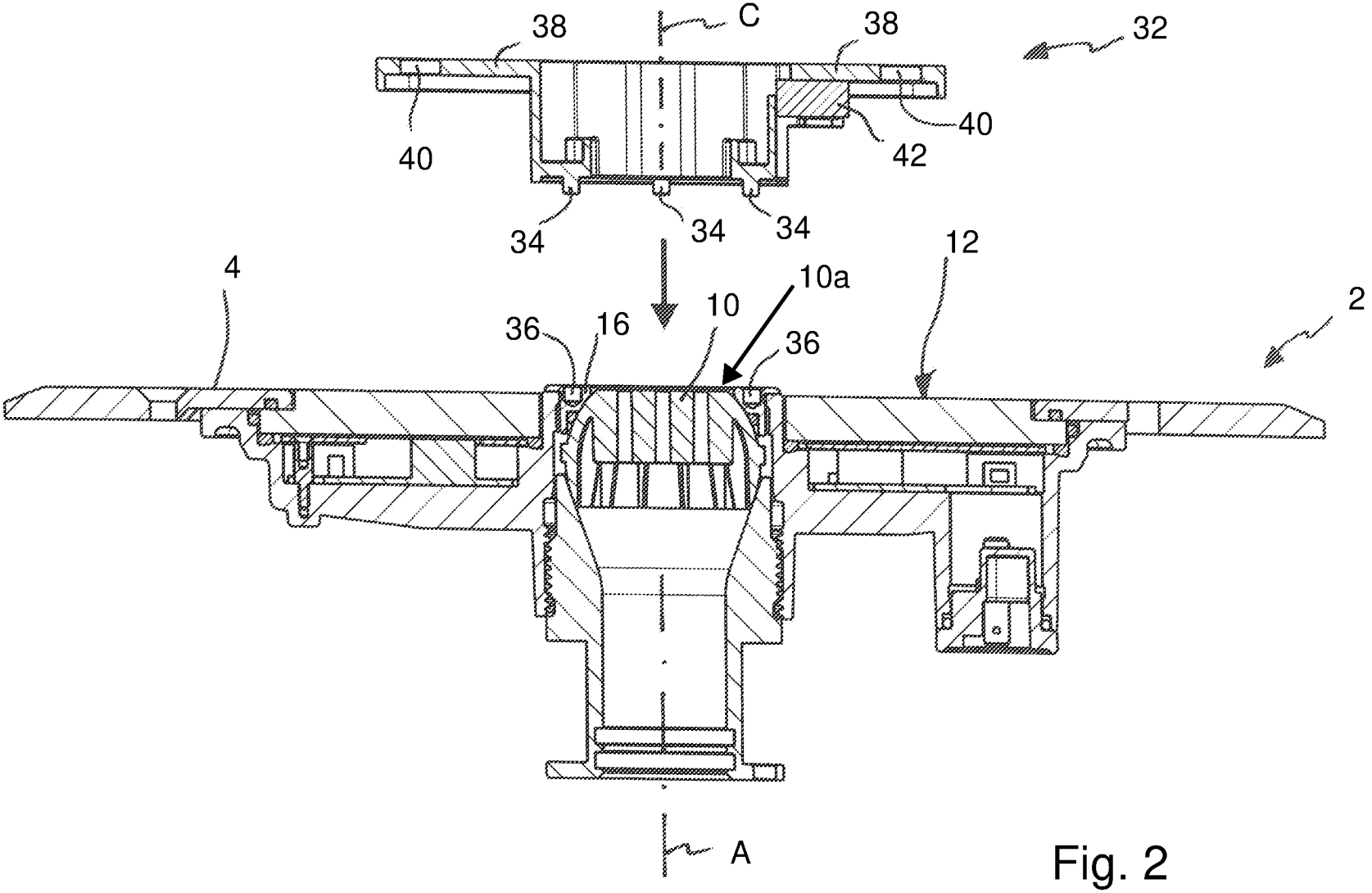
FIG. 2 shows a set according to the invention in a cross section view.

FIG. 2 shows a set according to the invention of a water feature 2 and an alignment and fixation tool 32. The alignment and fixation tool 32 comprises in circumferential direction about its centrally extending tool axis of rotation C four tool-associated contact elements 34 of which only three are visible here. The tool-associated contact elements 34, which are embodied in the form of projections extending in the direction of the water channel center axis A, are embodied in a complementary shape relative to four water feature-associated contact elements 36 of the securing element 16, which are in the form of recesses extending in the direction of the water channel center axis A and of which only two are visible here. The complementary configuration is such that the tool-associated contact elements 34 and the water feature-associated contact elements 36 can be brought into a form fit engagement or a form fit position. In this form fit position, the securing element 16 can be fixed or released by rotation of the alignment and fixation tool 32 about the tool axis of rotation C that is then parallel to the water channel center axis A.

Figure 3:
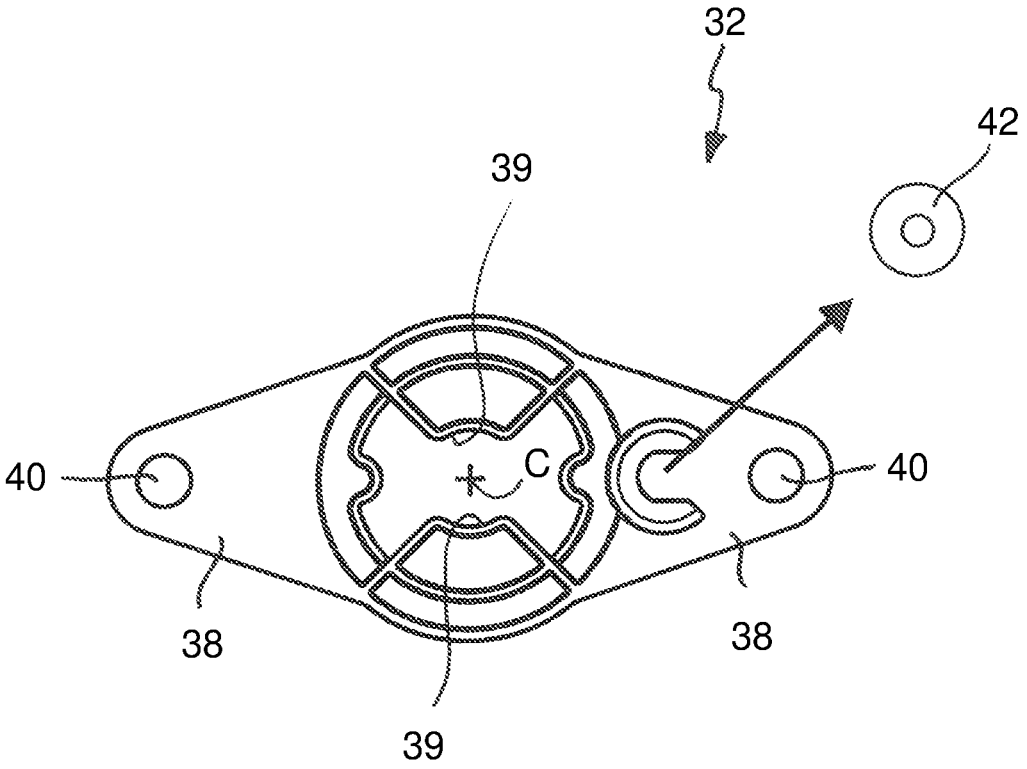
FIG. 3 shows a detail of the set according to the invention of FIG. 2 in a plan view.

FIG. 3 shows the alignment and fixation tool 32 in a plan view. The alignment and fixation tool 32 comprises two grip elements 38, which extend transversely to its tool axis of rotation C that in this illustration extends perpendicularly to the image plane. The grip elements 38 are positioned opposite each other and enable a comfortable one-hand operation. Each of the grip elements 38 comprises in addition an engagement region 40, here in the form of a continuous cutout, for engagement of a lever enlarging element. In this way, for increasing the leverage action as needed, one or a plurality of lever enlarging elements, for example, in the form of a lever extension, can be applied to the engagement regions 40.

For optimal alignment of the nozzle insert 10 and/or of the housing 4, the alignment and fixation tool 32 comprises a circular level 42 which is clipped removably into one of the grip elements 38.

Figure 4:
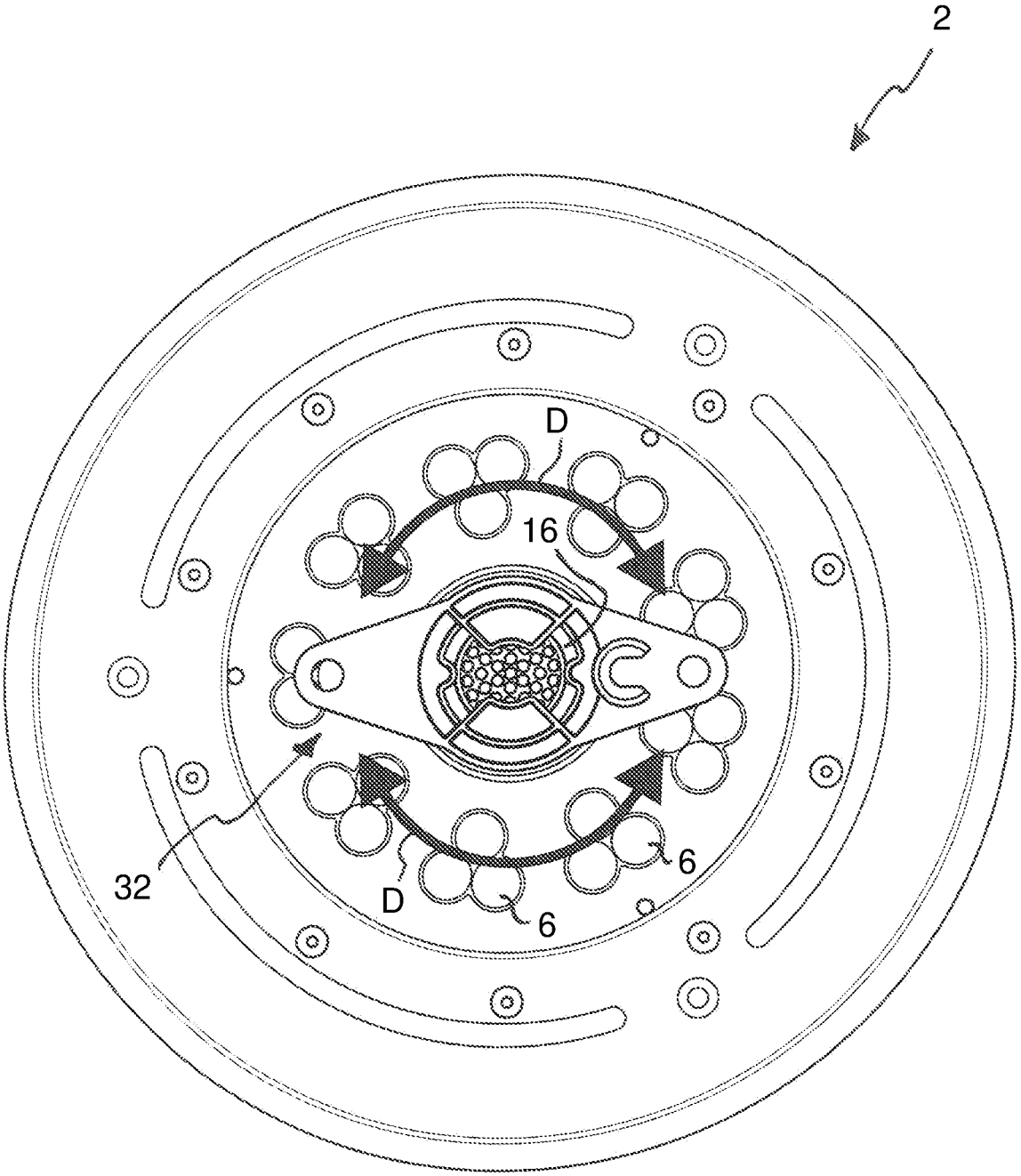
FIG. 4 shows the set according to the invention of FIG. 2 in a form fit engagement in a plan view.

FIG. 4 shows the water feature 2 and the alignment and fixation tool 32 in a plan view in which the tool-associated contact elements 34 have been brought into form fit engagement or into the form fit position with the water feature-associated contact elements 36. By rotation of the alignment and fixation tool 32 in the rotational direction D about the tool axis of rotation C, the securing element 16 can be released or fixed.

Figure 5:
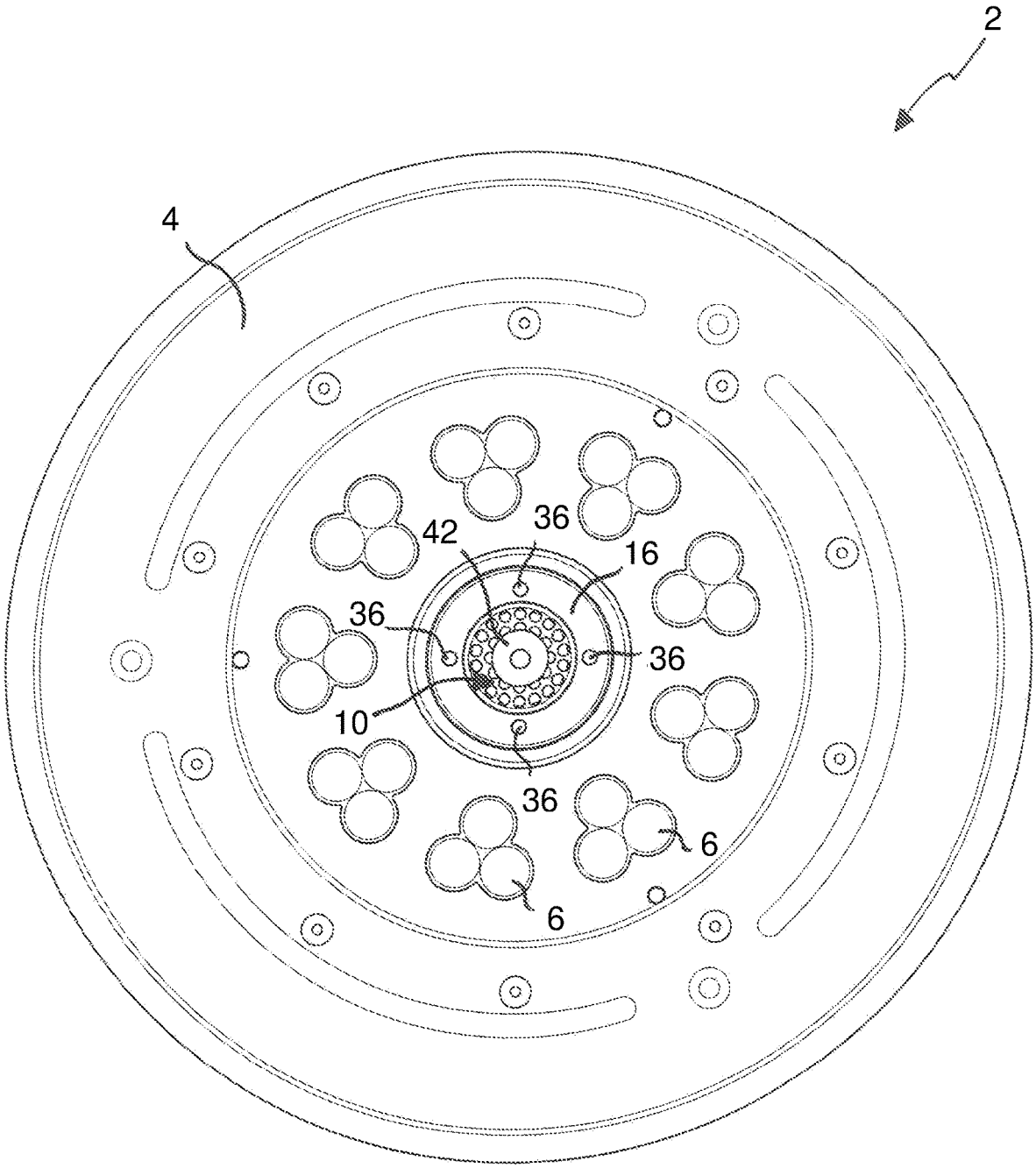
FIG. 5 shows a part of the set according to the invention of FIG. 4.

FIG. 5 shows the water feature 2 in plan view with the circular level 42 placed onto the planar top side 10*a* of the nozzle insert 10 which is precisely horizontally aligned; this is indicated by the central position of the gas bubble of the circular level 42.

The specification incorporates by reference the entire disclosure of German priority document 10 2020 101 238.1 having a filing date of Jan. 20, 2020.

While specific embodiments of the invention have been shown and described in detail to illustrate the inventive principles, it will be understood that the invention may be embodied otherwise without departing from such principles.

What is claimed is:

1. A water feature for generating an illuminated water image, the water feature comprising:

a housing that is an installation housing recessed in a receiving structure in an installed position of the housing;

the housing comprising a core housing recessed in the receiving structure in the installed position of the housing, the housing further comprising a cover arranged above the core housing and a light-transmissive glazing surrounded by the cover, wherein the cover comprises an under surface resting with a perimeter thereof on an upper surface of the receiving structure in the installed position of the housing, wherein the cover and the light-transmissive glazing form a flat top side of the housing;

an illumination unit fixedly arranged in the housing below the light-transmissive glazing;

a water channel passing through the housing;

a nozzle insert disposed in the water channel and configured to create a water image;

wherein the nozzle insert is configured to be pivotable relative to the illumination unit;

wherein the nozzle insert is configured to be pivotable about a pivot point, wherein the pivot point is positioned at the flat top side of the housing or below the flat top side of the housing.

2. The water feature according to claim 1, wherein the housing comprises a nozzle receptacle configured to accommodate at least a major portion of the nozzle insert or the entire nozzle insert, wherein the nozzle insert is insertable from the flat top side of the housing into the housing.

3. The water feature according to claim 1, further comprising a securing element configured to engage at least partially the nozzle insert and to secure the nozzle insert in the housing in an installed position of the securing element in the housing, wherein the securing element, in the installed position in the housing, is substantially flush with the flat top side of the housing.

4. The water feature according to claim 3, wherein the securing element is a securing ring with an outer thread configured to be screwed into the housing.

5. The water feature according to claim 1, wherein the nozzle insert and the housing together form a joint comprising an at least partially spherical segment-shaped guide contour and providing the pivot point.

6. The water feature according to claim 5, wherein the spherical segment-shaped guide contour is an outer contour of the nozzle insert.

7. The water feature according to claim 6, further comprising a securing element configured to engage at least partially the nozzle insert and to secure the nozzle insert in the housing in an installed position of the securing element in the housing, wherein the securing element comprises a centering inner surface which is facing the nozzle insert and comprises a shape complementary to the outer contour of the nozzle insert.

8. The water feature according to claim 1, wherein the nozzle insert is pivotable about a pivot range of at most ±45° relative to a pivot position of the nozzle insert in which the nozzle insert is coaxial to the water channel.

9. The water feature according to claim 1, wherein the housing comprises a flange insert insertable from a bottom side of the housing into a housing interior and configured to be releasably fixed.

10. The water feature according to claim 9, wherein the flange insert comprises a conical bearing contour configured to support the nozzle insert.

11. The water feature according to claim 1, wherein the nozzle insert comprises at least one guide projection projecting into a guide receptacle of the housing for limiting a pivot movement of the nozzle insert.

12. The water feature according to claim 11, wherein the nozzle insert and the housing together form a joint providing the pivot point, the joint comprising an at least partially spherical segment-shaped guide contour provided on an outer contour of the nozzle insert, wherein the at least one guide projection is arranged on the outer contour.

13. A set comprising:

a water feature according to claim 1;

an alignment and fixation tool, wherein the alignment and fixation tool comprises at least one first contact element;

wherein the water feature comprises a securing element comprising at least one second contact element complementary to the at least one first contact element;

wherein the at least one first contact element is complementary to the at least one second contact element such that the at least one first contact element and the at least one second contact element are configured to be brought into a form fit engagement with each other so that a rotation of the alignment and fixation tool causes the securing element to be fixed or released.

14. The set according to claim 13, wherein the rotation of the alignment and fixation tool is carried out about a tool axis of rotation extending parallel to or coinciding with a water channel center axis of the water channel in a form fit position.

15. The set according to claim 13, wherein the at least one first contact element is a projection and the at least one second contact element is a recess, or the at least one first contact element is a recess and the at least one second contact element is a projection, wherein a connection is formed by the projection engaging the recess.

16. The set according to claim 15, wherein the projection and the recess extend parallel to a water channel center axis of the water channel.

17. The set according to claim 13, wherein a plurality of the at least one first contact element are provided, including a first recess and a first projection, wherein a plurality of the at least one second contact element are provided, including a second recess and a second projection, wherein a connection is formed by the first projection engaging the second recess and by the first recess engaging the second projection.

18. The set according to claim 13, wherein the alignment and fixation tool comprises two or more of the first contact elements which are distributed in a circumferential direction about the tool axis of rotation.

19. The set according to claim 13, wherein the alignment and fixation tool comprises one or more grip elements extending transversely to the tool axis of rotation.

20. The set according to claim 19, wherein two of the grip elements are provided and are positioned opposite each other in relation to the tool axis of rotation.

21. The set according to claim 19, wherein the one or more grip elements comprise at least one engagement region configured to engage a lever enlarging element.

22. The set according to claim 13, wherein the alignment and fixation tool comprises a circular level.

23. The water feature according to claim 1, wherein the nozzle insert comprises a planar top side, wherein the planar top side of the nozzle insert is substantially flush with the flat top side of the housing at least in one pivot position of the nozzle insert.

* * * * *